United States Patent [19]

Rossigno et al.

[11] Patent Number: 4,738,186

[45] Date of Patent: Apr. 19, 1988

[54] DIAPHRAGM FOR A SERVOMOTOR

[75] Inventors: Louis P. Rossigno, Granger, Ind.; Robert F. Shellhamer, Rochester, Mich.; Gregory K. Harrison, South Bend, Ind.

[73] Assignee: Allied Corporation, Morristown, N.J.

[21] Appl. No.: 926,605

[22] Filed: Nov. 4, 1986

[51] Int. Cl.[4] ..... F01B 19/00

[52] U.S. Cl. ..... 92/98 D; 92/99; 91/376 R

[58] Field of Search ..... 92/98 R, 98 D, 99, 100; 91/376 R, 369 A, 369 B, 369 C, 369 R

[56] References Cited

U.S. PATENT DOCUMENTS

| | | | |
|---|---|---|---|
| 3,958,497 | 5/1976 | Gardner et al. | 92/99 X |
| 4,328,738 | 5/1982 | Hamamatsu | 92/99 X |
| 4,418,611 | 12/1983 | Tateoka et al. | 92/98 D X |
| 4,491,056 | 1/1985 | Tsubouchi | 92/98 D X |
| 4,522,108 | 6/1985 | Takeuchi et al. | 92/98 D X |

FOREIGN PATENT DOCUMENTS

| | | | |
|---|---|---|---|
| 21969 | 1/1981 | European Pat. Off. | 92/98 D |
| 2481381 | 4/1981 | France | 92/98 D |

*Primary Examiner*—Robert E. Garrett
*Assistant Examiner*—Mark A. Williamson
*Attorney, Agent, or Firm*—Leo H. McCormick, Jr.; Ken C. Decker

[57] ABSTRACT

A diaphragm (32) for a servomotor which separates the interior of first (12) and second (14) shells into first (18) and second (20) chambers. The diaphragm (32) has an external bead (30) with first rib (31) having first (40) and second (42) sealing surfaces and an annular projection (46) extending therefrom which engages the rear shell (14) or divider (15) to guide the first (40) and second (42) sealing surfaces into contact with corresponding surfaces on the first (12) and second (14) shells. When the first (12) shell is connected to the second (14) shell, the projection (46) is compressed into the first rib (31) while a portion (33, 35) of the first rib (31) expands into cavities (37, 39) on both sides of the annular projection (46) to develop internal resiliency that uniformly acts on the first (40) and second (42) sealing surfaces. The diaphragm (32) has an internal bead (34) with a second rib (56) that snaps into a groove (36) on the hub (38) located in the servomotor. The internal bead (34) has a rib (56) with a flange (82) thereon. The flange (82) has a scalloped surface (84) which allows the rib (56) to expand radially and be positioned in the groove (36) while providing sufficient axial rigidity to hold a backing plate (70) against a force transmitting shoulder (88) on the hub (38). Leading (64) and trailing (72) edges and sealing rings (78, 80) engage the hub (38) within the groove (36) to seal the first chamber (18) from the second (20) chamber.

6 Claims, 1 Drawing Sheet

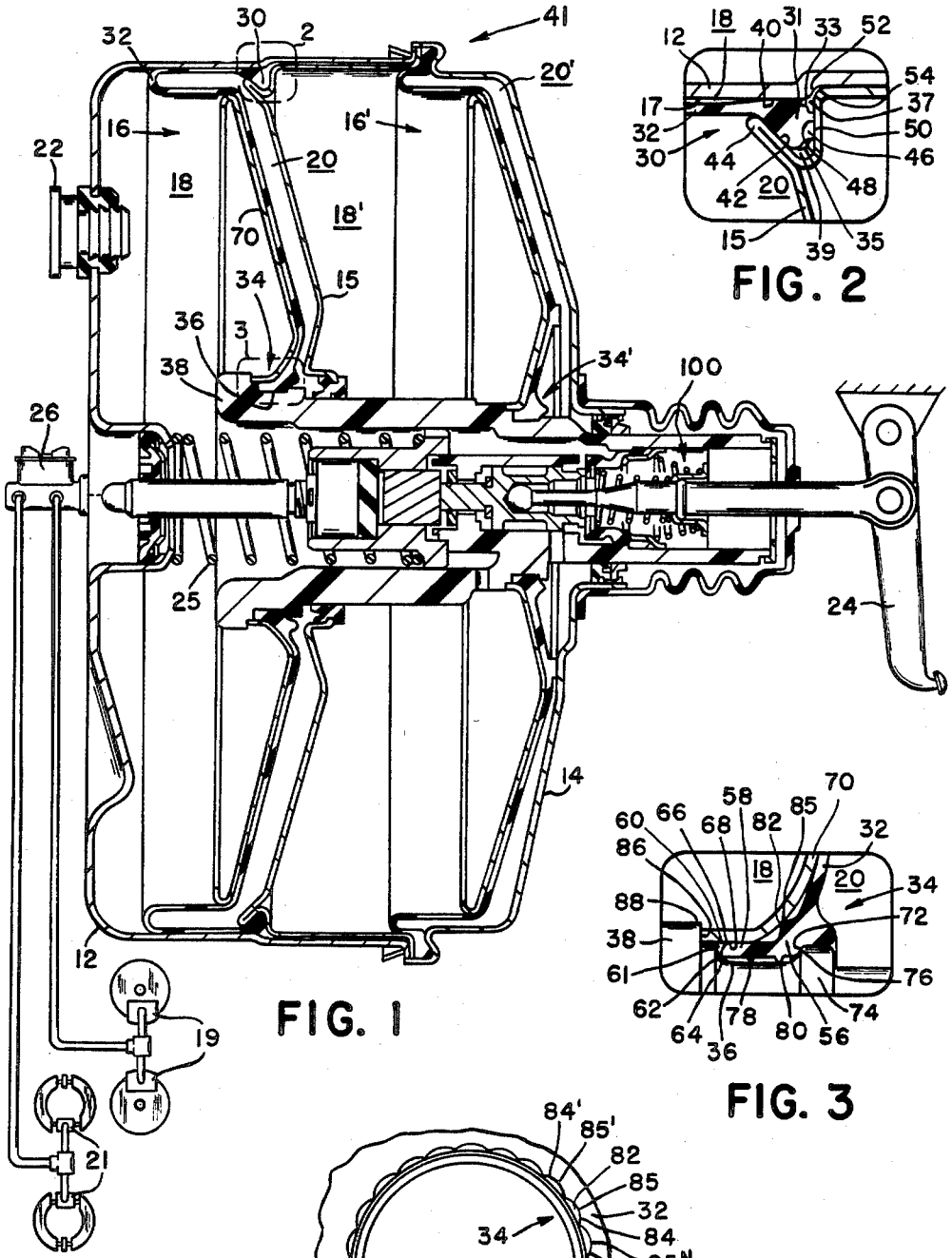
FIG. 1
FIG. 2
FIG. 3
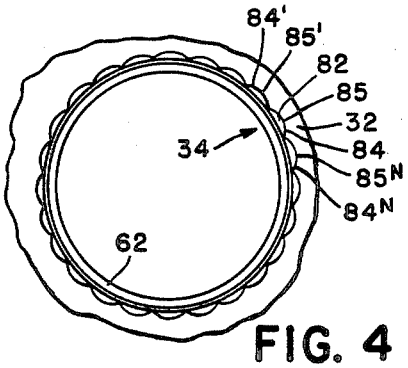
FIG. 4

DIAPHRAGM FOR A SERVOMOTOR

This invention relates to a diaphragm for a servomotor wherein the internal and external beads have multiple sealing surfaces to separate a first chamber from a second chamber.

During manufacture of servomotors used as a power source for a brake system, the diameter of the front and rear shells may be distorted as the tolerances in dies change as a result of use. Should the tolerances for such shells and beads on a diaphragm that separate the interior of the shells into first and second chamber reach a maximum in opposite directions, when the front shell is connected to the rear shell and the diaphragm connected to the hub of the valve control with the servomotor, a potential leak could occur when vacuum is introduced into the first and second chambers. A possible solution is to correct leaks that occur between the shells is shown in U.S. Pat. No. 3,977,299 wherein a groove is placed in the shell to urge the head of the diaphragm into engagement with a flange on the rear shell. Unfortunately, placing the groove in the front shell adds to the manufacturing cost of a servomotor.

U.S. Pat. No. 4,569,276 discloses a servomotor whereby conical surfaces are placed on the front and rear shells to compensate for tolerance mismatched parts. The conical surfaces assure that some areas will engage each other to define a sealing surface for the external beads. Unfortunately, under certain tolerance situations it is possible for bead on the diaphragm to be extruded into the conical surface areas and as a result, either the bead is cut or the locking tabs on the shells cannot be fully staked.

Heretofore when diaphragm construction was evaluated it was thought that the inner bead construction could be designed with an inner diameter small enough to compensate for any tolerance problems in either the hub or diaphragm. Unfortunately if the tolerance on the bead is in one direction and the tolerance in the hub is in the opposite direction, damage can occur in the bead which thereafter may allow a leak to develop between the first and second chambers.

The diaphragm of the instant invention has inner and outer beads which are designed to compensate for tolerance differences between components and establish a seal which prevents communication between the first and second chambers within a servomotor. The outer bead on the diaphragm has a rib with first and second sealing surfaces thereon and an axial projection that engages the rear shell. The axial projection on attachment of the rear shell to the front shell is compressed into the rib while a portion of the rib expands out into first and second cavities formed on both sides of the annular projection. The first and second sealing surfaces and annular projection form a wedge which is urged by the internal resiliency or compression force that is created in the rib into engagement with the first and second shells to establish a sealing relationship therewith.

The inner bead has a rib which snaps into a groove in the hub of the movable wall of the servomotor. The rib has a flange with a scalloped surface which allows the rib to radially expand and yet have sufficient internal resiliency to urge and hold a backing plate against a force receiving shoulder on the hub. The rib has leading and trailing edges that engages the groove to establish a seal between the front and rear chambers.

An advantage that this diaphragm offers is its ability to compensate for manufacturing tolerances that could allow a leak path to develop between first and second chambers in a servomotor.

It is an object of this invention to provide a servomotor with a diaphragm for use in a movable wall that has internal and external beads that are designed to compensate for dimensional tolerances in the shells and hub that may allow a leak path to develop.

The object and advantages of the diaphragm disclosed in this invention should be apparent from reading this specification while viewing the drawing.

BRIEF DESCRIPTION OF THE DRAWINGS

FIG. 1 is a schematic illustration of a brake system having a sectional view of a servomotor with a diaphragm made according to the principles of this invention;

FIG. 2 is an enlarged view of the outer bead of the diaphragm showing its relationship with the front and rear shell of the servomotor;

FIG. 3 is an enlarged view of the inner bead of the diaphragm showing its relationship with the backing plate and hub of the servomotor; and FIG. 4 is a perspective view of the inner bead showing the flange with the fluted or scalloped surface thereon which engages the backing plate.

DETAILED DESCRIPTION OF THE INVENTION

In the fluid pressure servomotor 10 shown in FIG. 1, a front shell 12 is joined to a rear shell 14 by a twist lack arrangement 41 to form a housing. Wall arrangements 16 and 16' divide the housing into a front chamber 18 and a rear chamber 20. The front chamber 18 is connected to a source of vacuum through conduit 22 and to the rear chamber 20 through a valve 100 of the type disclosed in U.S. Pat. No. 3,977,299. In response to an input applied to brake pedal 24, the valve 100 is actuated and air is allowed to enter chamber 20 to create a pressure differential across the wall arrangements 16 and 16'. The pressure differential acts on and moves the wall arrangements 16 and 16' toward the front chamber 18. Movement of the wall arrangements 16 and 16' produces a force that is transferred to pistons in a master cylinder 26 to provide the brakes 19 and 21 of the front and rear wheels with pressurized fluid to effect a brake application. On termination of the input force on pedal 24, a return spring 25 acts on and moves the wall arrangements 16 and 16' toward its rest position shown in FIG. 1 as vacuum in the front chamber 18 evacuates air from rear chamber 20.

If the outer bead 30 on the diaphragm 32 of the wall arrangement 16 is not sealed with respect to the front and rear shells 12 and 14, respectively, or inner bead 34 is not sealed with respect to groove 36 in hub 38, a leak path for air may occur in chambers 18 and 20 and reduce the vacuum level therein. If the vacuum level is reduced, any resulting pressure differential development and consequently the output force could be adversely effected.

The diaphragm 32 has an outer bead 30 which is shown in detail in FIG. 2. Bead 30 has a rib with a first surface 40 that engages the front shell 12, a second surface 42 that engages lip 44 on divider 15 and an annular projection 46. Face 48 on projection 46 engages radial surface 50 on divider 15 and holds surface 40 in alignment with the interior surface 17 of shell 12. When rib 31 is placed between lip 44, radial surface 50 and the interior surface 17, projection 46 is compressed into rib 31 and portions 33 and 35 expand out into cavities 37 and 39 formed between projection 46 and divider 15. The bulge 33 is such that it does not extent into the conical sections 52 and 54 on shell 12 and divider 15 respectively. However, the compressive force that urges the annular projection 46 into rib 31 and develops bulges 33 and 35 to produce an internal resiliency force that uniformly acts on surfaces 40 and 42 seals the first chamber 18 from the second chamber 20.

The diaphragm 32 has an inner bead 34 which has a rib 56 as best shown in FIGS. 3 and 4 that snaps into groove 36. Rib 56 has a lip 58 that has a leading edge 60 with a first surface 64 that engages tapered slope 62 in groove 36 and a second surface 66 that engages surface 68 on backing plate 70. The leading edge 60 forms the first sealing surface that separates the first chamber 18 from the second chamber 20. Rib 56 has a trailing edge 72 that engages land 74 on hub 38 to form a sealing surface with surface 76. A pair of sealing rings 78 and 80 engage groove 36 to form additional sealing surfaces. The rib 56 has a flange 82 with a scalloped surface formed by a plurality of semi-spherical ribs 84, 84', . . . $84^N$. The ribs 84, 84', . . . $84^N$ have a contact point 85, 85', . . . $85^N$, that engage surface 68 on the backing plate 70 to hold end 86 against shoulder 88 on the hub 38 through which the force developed by the pressure differential across wall 16 is transmitted into hub 38.

The flange 82 and the scalloped surface allows rib 56 to expand radially in order to move over land 74 while at the same time the thickness of the flange 82 and engagement of the contact points 85, 85', . . . $85^N$ provide sufficient axial rigidity and resiliency to bias and hold end 68 against shoulder 88. The internal resiliency of rib 56 is such that once the trailing edge 72 engages surface 76, surfaces 64 and 66 of the leading edge 60 are urged into sealing engagement with the backing plate surface 68 and groove 36 in hub 38 and sealing rings 78 and 80 engage groove 36 to separate the first chamber 18 from the second chamber 20.

Beads 30 and 34 on diaphragm 32 are shown in FIGS. 2 and 3 located in a servomotor wherein tolerance dimensions are in the maximum permissable upper limits with cavities 37 and 39 formed between projection 46 and radial surface 50, shell 12 and space 61 between hub 38, the leading edge 60 and backing plate 70 to provide for at least minimum sealing. When the components are manufactured in the normal manner, the beads 30 and 34 substantially fill the cavity 37 and 39 and space 61 to provide for a greater sealing surface and thereby assure that the first and second chambers remain separated.

The diaphragm 16 has been described as being used in a tandem brake booster in FIG. 1. The diaphragm 16' shown as being located adjacent the rear shell 14 is substantially identical in construction and functions in the same manner to seal chamber 18' from chamber 20'.

We claim:

1. A diaphragm having an outer periphery held between first and second shells and an inner periphery that engages a hub member and a backing plate to define a wall which divides the interior of a servomotor housing formed by the first and second shells into first and second chambers, the improvement in said diaphragm comprising:

a first bead on said outer periphery having a first rib with an annular axial projection located at approximately equal distance from a first surface and a second surface, said axial projection having a guide surface thereon which engages one of said first and second shells to align said first and second surfaces with corresponding surfaces on the first and second shells, said first surface and said guide surface on said axial projection being located in substantially perpendicular planes while said second surface is located in a plane approximately 45° to both the first surface and said guide surface to produce a wedge shape between said first and second surfaces and said first and second shells, said annular axial projection being compressed into said first rib on attachment of said first shell with said second shell to establish first and second seals with said first and second surfaces and corresponding surfaces on said first and second shells, said axial projection being compressed into said first rib to establish a sealing force between said first and second surfaces and said first and second shells, said compression of said axial projection causing a portion of said first rib to expand into first and second cavities formed between said axial projection and one of said first and second shells to establish an internal resiliency such that a resulting sealing force of said first bead is substantially uniform; and a second bead having a second rib located in a groove in said hub and a leading edge that engages a first sealing surface in said groove and a trailing edge that engages a second sealing surface in said groove, said second rib having a flange, said flange having a scalloped surface with sufficient radial resiliency to expand and allow said leding and trailing egdges to snap into said groove and sufficient axial rigidity to hold and move said backing plate against a force receiving surface to assure that said leading and trailing edges remain in contact with said first and second sealing surfaces during movement of said hub.

2. The diaphragm as recited in claim 1 wherein said second rib further includes:

a plurality of rings located between said leading and trailing edge, said rings engaging said groove to further assist in sealing said first chamber from said second chamber.

3. The diaphragm as recited in claim 2 wherein said second rib further includes:

a top surface that engages said backing plate to aid in holding said leading edge against the first sealing surface.

4. A diaphragm having an outer periphery held between first and second shells and an inner periphery that engages a hub member to define a wall which divides the interior of a servomotor housing formed by the first and second shells into first and second chambers, the improvement in said diaphragm comprising:

a first bead on said outer periphery having a first rib with an annular axial projection located at approximately equal distance from a first surface and a second surface, said axial projection having a guide surface thereon which engages one of said first and second shells to align said first and second surfaces with corresponding surfaces on the first and second shells, said annular axial projection being compressed into said first rib on attachment of said first shell with said second shell to establish first and second seals with said first and second surfaces and corresponding surfaces on said first and second shells, said axial projection being compressed into said first rib to establish a sealing force between said first and second surfaces and said first and second shells, said compression of said axial projection causing a portion of said first rib to expand into first and second cavities formed between said axial projection and one of said first and second shells to establish an internal resiliency such that a resulting sealing force of said first bead is substantially uniform; and a second bead having a second rib located in a groove in said hub and with a leading edge that engages a first sealing surface in said groove and a trailing edge that engages a second sealing surface in said groove, said second rib having a flange, said flange having a scallop surface which allows said second rib to expand radially and allow said leading and trailing edges to snap into said groove and sufficient axial rigidity to hold and move said backing plate against a force receiving surface to assure that said leading and trailing edges remain in contact with said first and second sealing surfaces during movement of said hub.

5. The diaphragm as recited in claim 4 wherein said second rib further includes:

a plurality of rings located between said leading and trailing edge, said rings engaging said groove to further assist in sealing said first chamber from said second chamber.

6. The diaphragm as recited in claim 5 wherein said second rib further includes:

a top surface that engages said backing plate to aid in holding said leading edge against the first sealing surface.

* * * * *